US008998567B2

(12) United States Patent
Scipio et al.

(10) Patent No.: US 8,998,567 B2
(45) Date of Patent: Apr. 7, 2015

(54) METHOD, SYSTEM AND APPARATUS FOR ENHANCED OFF LINE COMPRESSOR AND TURBINE CLEANING

(75) Inventors: Alston Ilford Scipio, Mableton, GA (US); Sanji Ekanayake, Mableton, GA (US)

(73) Assignee: General Electric Company, Schenectady, NY (US)

( * ) Notice: Subject to any disclaimer, the term of this patent is extended or adjusted under 35 U.S.C. 154(b) by 561 days.

(21) Appl. No.: 13/492,333

(22) Filed: Jun. 8, 2012

(65) Prior Publication Data

US 2013/0330172 A1 Dec. 12, 2013

(51) Int. Cl.
*F01D 25/00* (2006.01)

(52) U.S. Cl.
CPC ..... *F01D 25/002* (2013.01)

(58) Field of Classification Search
CPC ..... F01D 25/002
See application file for complete search history.

(56) References Cited

U.S. PATENT DOCUMENTS

| | | | | |
|---|---|---|---|---|
| 6,657,715 | B2 | 12/2003 | Vaez-Iravani et al. | |
| 2002/0141882 | A1 | 10/2002 | Ingistov et al. | |
| 2003/0133789 | A1 * | 7/2003 | Kuesters et al. | 415/116 |
| 2007/0000528 | A1 * | 1/2007 | Asplund et al. | 134/166 R |
| 2007/0048127 | A1 | 3/2007 | O'Neill et al. | |
| 2008/0149141 | A1 * | 6/2008 | Sales | 134/22.1 |
| 2009/0158739 | A1 | 6/2009 | Messmer | |
| 2010/0212703 | A1 * | 8/2010 | de la Bruere-Terreault et al. | 134/166 R |
| 2012/0134777 | A1 * | 5/2012 | Eleftheriou et al. | 415/115 |

FOREIGN PATENT DOCUMENTS

| | | | |
|---|---|---|---|
| EP | 1903188 | A2 | 3/2008 |
| GB | 796269 | A | 6/1958 |

OTHER PUBLICATIONS

Search Report and Written Opinion from EP Application No. 13170818.2 dated Sep. 26, 2013.

* cited by examiner

*Primary Examiner* — Dwayne J White
*Assistant Examiner* — William Grigos
(74) *Attorney, Agent, or Firm* — Armstrong Teasdale LLP

(57) ABSTRACT

Methods, systems and apparatus for cleaning turbines, such as power generation turbines, are disclosed. Supplemental piping is connected to existing compressor air extraction and turbine nozzle cooling air piping, to supply water and/or cleaning agents into areas of a turbine not ordinarily accessible by injection of water and/or cleaning agents into the bellmouth of the turbine alone. Pressure and flow sensors, pumps, valving, and a control system to regulate the operation of the pumps and valving are provided to control the introduction of water and/or cleaning agents into the turbine.

20 Claims, 7 Drawing Sheets

METHOD, SYSTEM AND APPARATUS FOR ENHANCED OFF LINE COMPRESSOR AND TURBINE CLEANING

BACKGROUND OF THE INVENTION

This invention relates generally to turbines, such as are used for power generation, and, more specifically, to methods, systems and apparatus for cleaning turbines.

A turbine, such as is used for power generation, may use a variety of fuels, such as natural or synthetic gas, and atomized liquid fuels of various weights and viscosities. No matter what fuel is used, the blades and other structures in the turbine are subject over time to the build up of deposits of various residues that are byproducts of the combustion process. Deposit build up results in loss of turbine efficiency and potential degradation of turbine components.

Efforts to address the build up of combustion by-product deposits include washing the turbine at periodic intervals. Known washing methods involve the spraying of water and/or cleaning agents axially into the bellmouth of the turbine through predetermined nozzle arrangements, while the turbine is rotated at a relatively slow speed. However, such known methods typically result in effective cleaning only to about the seventh stage of the compressor portion of the turbine. Often, the water and/or cleaning agents are degraded or vaporized by the time the latter stages are reached. Furthermore, such known techniques can result in debris or deposit build up material simply migrating to the higher (downstream) stages of the turbine. In addition, nozzle plugging can also reduce cleaning effectiveness. Also, dedicated nozzles can become plugged, leading to undesired variations in spray pattern and loss of efficiency.

Other known methods for cleaning turbines have included increasing the duration and/or frequency of the washes, increasing the ratio of cleaning agent to water, changing the type of cleaning agent used, use of foam-based cleaning agents (which migrate more easily into tight areas and the latter stages of turbines), and/or implementing a policy of periodic manual cleaning.

BRIEF DESCRIPTION OF THE INVENTION

In an aspect, a turbine engine system is provided. The turbine engine system includes a turbine engine including a compressor section, a turbine section, compressor section air extraction piping, and turbine section air extraction piping. The turbine engine system further includes water supply piping, connected in flow communication with a supply of water. The turbine engine system further includes cleaning agent supply piping connected in flow communication with at least one supply of cleaning agent. The turbine engine system further includes a mixing chamber, connected in flow communication with the water supply piping and the cleaning agent supply piping, the mixing chamber being configured to receive water from the water supply piping and at least one cleaning agent from the cleaning supply piping, and produce a cleaning mixture. The turbine engine system further includes cleaning mixture supply piping, connected in flow communication with the mixing chamber, the cleaning mixture supply piping being connected in flow communication with the compressor section air extraction piping and the turbine section air extraction piping to selectively supply cleaning mixture to one of the compressor section and the turbine section. The turbine engine system further includes at least one pump, connected in flow communication with at least one of the water supply piping, the cleaning agent supply piping, and the cleaning mixture piping. The turbine engine system still further includes a control system, connected to the water supply piping, the cleaning agent supply piping, the cleaning mixture piping, and the at least one pump, the control system operably configured to regulate flow of water, cleaning agent, and cleaning mixture through the water supply piping, the cleaning agent supply piping, and the cleaning mixture supply piping, respectively.

In another aspect, a method for cleaning a turbine engine having a compressor section, a turbine section, compressor air extraction piping and turbine air extraction piping is provided. The method includes connecting water supply piping in flow communication with a supply of water. The method further includes connecting cleaning agent supply piping in flow communication with at least one supply of cleaning agent. The method further includes connecting a mixing chamber in flow communication with the water supply piping and the cleaning agent supply piping, the mixing chamber configured to receive water from the water supply piping and at least one cleaning agent from the cleaning supply piping, and produce a cleaning mixture. The method further includes connecting cleaning mixture supply piping in flow communication with the mixing chamber. The method further includes connecting the cleaning mixture supply piping connected in flow communication with the compressor section air extraction piping and the turbine section air extraction piping to selectively supply cleaning mixture to one of the compressor section and the turbine section. The method further includes connecting a control system to the water supply piping, the cleaning agent supply piping, and the cleaning mixture piping to regulate flow of water, cleaning agent, and cleaning mixture through the water supply piping, the cleaning agent supply piping, and the cleaning mixture supply piping, respectively.

In still another aspect, a system for cleaning a turbine engine having a compressor section, a turbine section, compressor air extraction piping and turbine air extraction piping is provided. The system includes water supply piping, connected in flow communication with a supply of water. The system further includes cleaning agent supply piping connected in flow communication with at least one supply of cleaning agent. The system further includes a mixing chamber, connected in flow communication with the water supply piping and the cleaning agent supply piping, the mixing chamber being configured to receive water from the water supply piping and at least one cleaning agent from the cleaning supply piping, and produce a cleaning mixture. The system further includes cleaning mixture supply piping, connected in flow communication with the mixing chamber, the cleaning mixture supply piping being connected in flow communication with the compressor section air extraction piping and the turbine section air extraction piping to selectively supply cleaning mixture to one of the compressor section and the turbine section. The system further includes at least one pump, connected in flow communication with at least one of the water supply piping, the cleaning agent supply piping, and the cleaning mixture piping. The system further includes a control system, connected to the water supply piping, the cleaning agent supply piping, the cleaning mixture piping, and the at least one pump, the control system operably configured to regulate flow of water, cleaning agent, and cleaning mixture through the water supply piping, the cleaning agent supply piping, and the cleaning mixture supply piping, respectively.

DETAILED DESCRIPTION OF THE INVENTION

Figure 1:
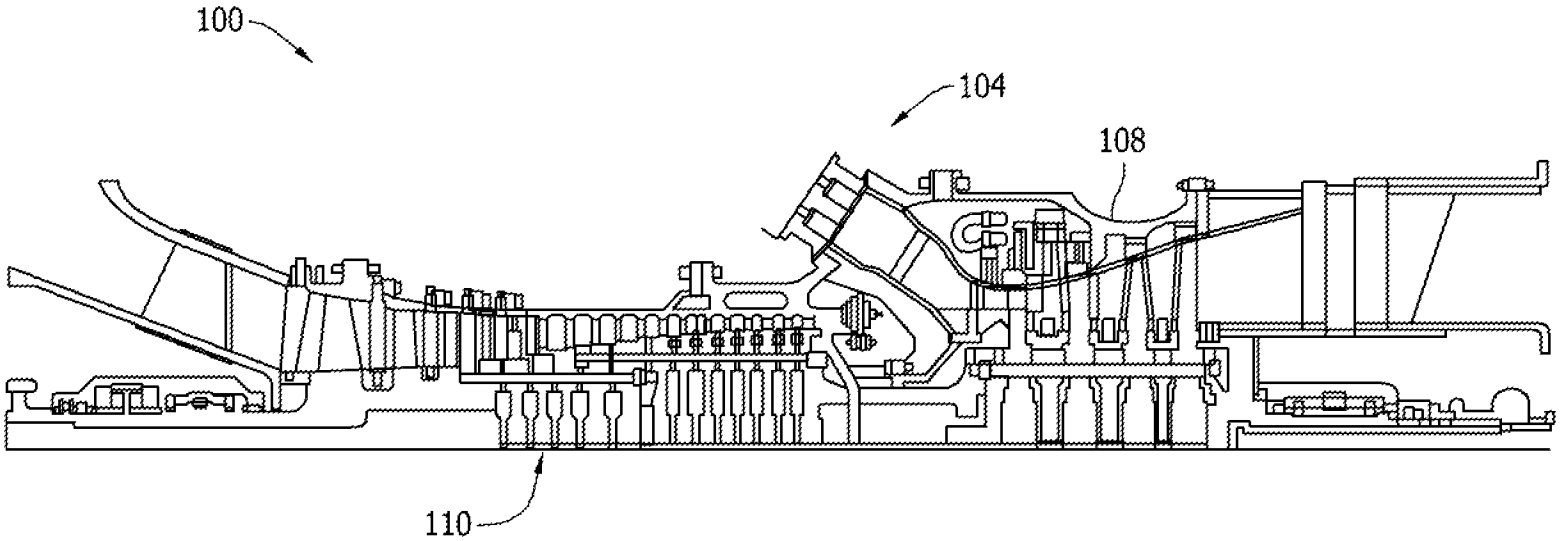
FIG. 1 is a schematic side elevation, in section, of an exemplary turbine engine.

FIG. 1 is a schematic illustration of an exemplary gas turbine engine 100. Engine 100 includes a compressor section 102 and a combustor assembly 104. Engine 100 also includes a turbine section 108 and a common compressor/turbine shaft 110 (sometimes referred to as a rotor 110).

In operation, air flows through compressor section 102 such that compressed air is supplied to combustor assembly 104. Fuel is channeled to a combustion region and/or zone (not shown) that is defined within combustor assembly 104 wherein the fuel is mixed with the air and ignited. Combustion gases generated are channeled to turbine section 108 wherein gas stream thermal energy is converted to mechanical rotational energy. Turbine section 108 is rotatably coupled to shaft 110. It should also be appreciated that the term "fluid" as used herein includes any medium or material that flows, including, but not limited to, gas and air.

Figure 2:
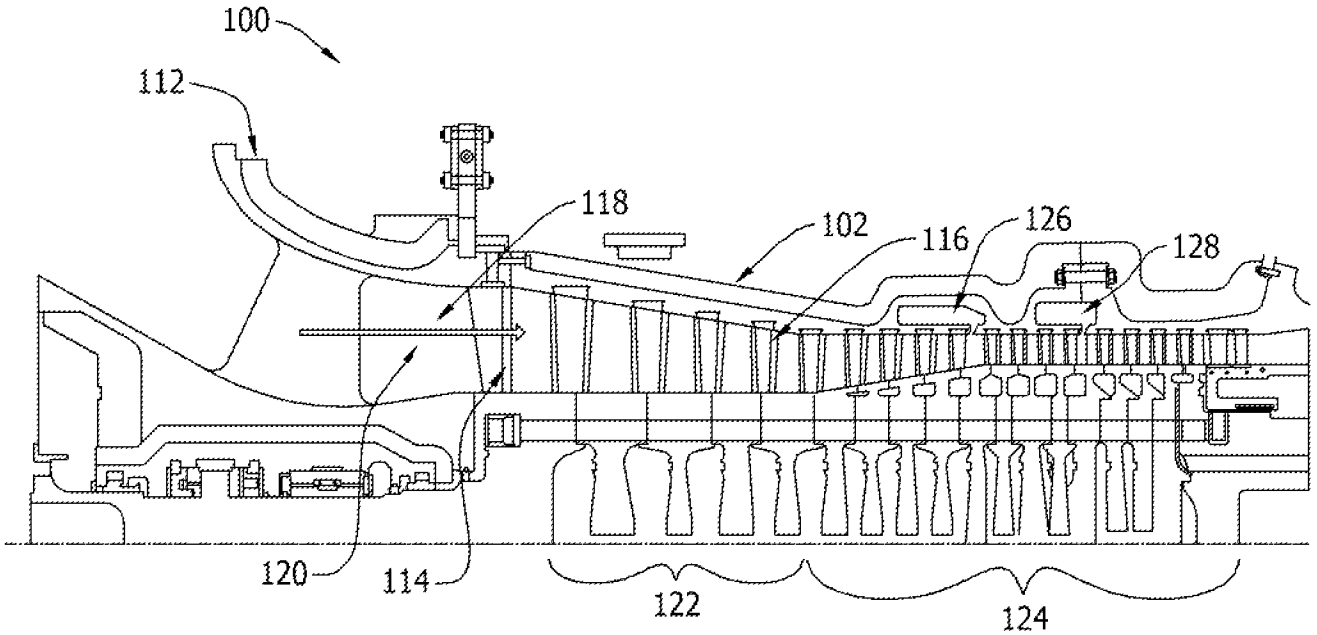
FIG. 2 is a schematic illustration of a compressor section of an exemplary turbine engine.

FIG. 2 is a schematic illustration of a compressor section of an exemplary turbine engine 100. Engine 100 further includes compressor bellmouth 112, inlet guide vanes 114, and compressor stator vanes 116. As discussed, known washing methods involve the placement 118 of water wash nozzles (not shown), such that wash water follows a generally axial path 120 through compressor 102. Known washing methods typically result in effective cleaning only through the first seven (or fewer) stages 122 of compressor 102, with the latter stages 124 of compressor 102 not receiving adequate cleaning. Entry points 126, 128 indicate entry points for introduction of water and/or cleaning agents in an exemplary embodiment of the method, system and apparatus discussed herein, being located at the ninth ($9^{th}$) stage and the thirteenth ($13^{th}$) stages, respectively, of compressor 102.

Figure 3:
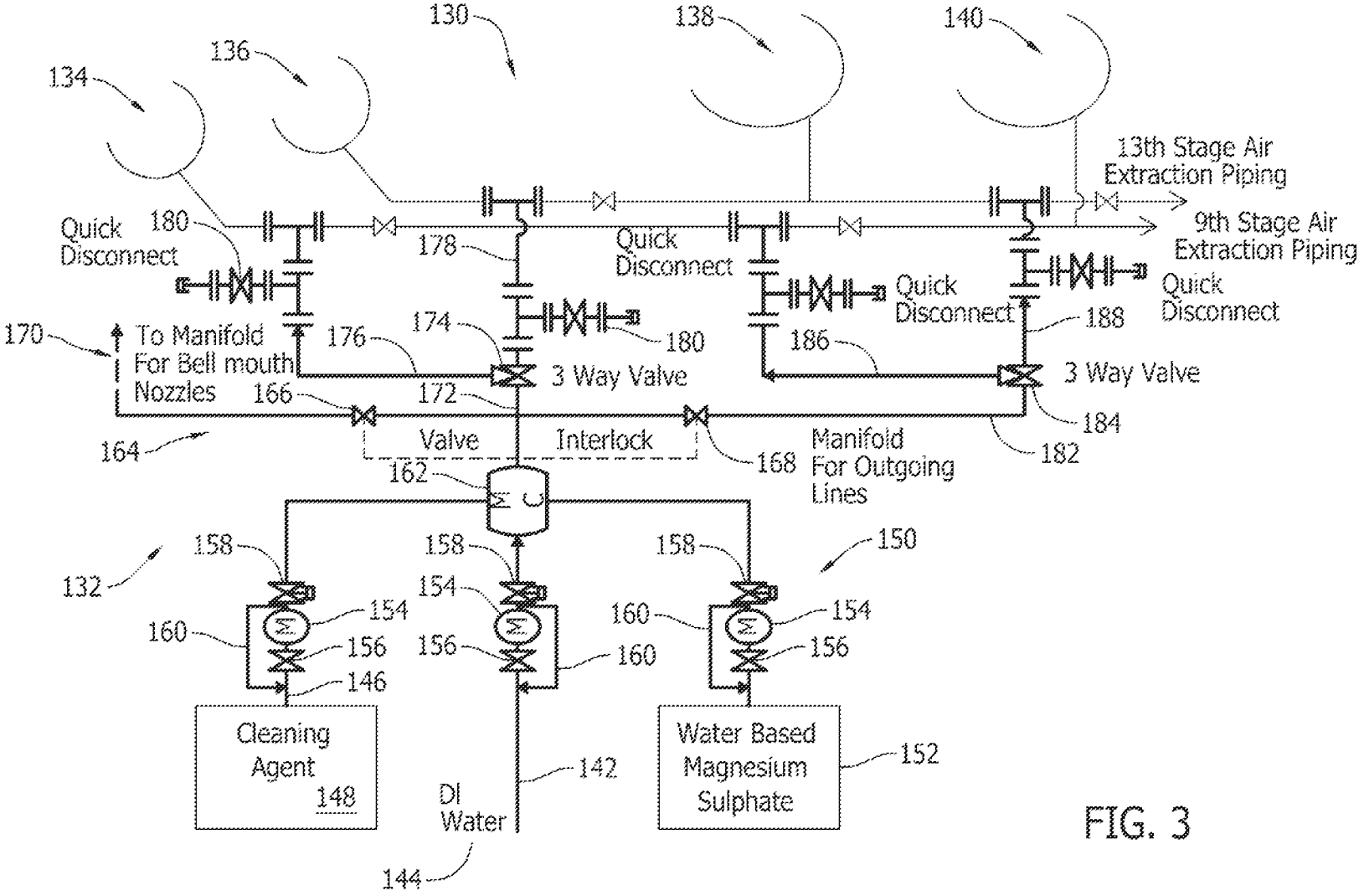
FIG. 3 is a schematic illustration of an exemplary piping arrangement for supplying water and/or cleaning agents into a turbine engine.

FIG. 3 is a schematic illustration of an exemplary system 130 for washing turbine engine 100, including piping 132 for supplying water and/or cleaning agents into turbine 100. In an exemplary embodiment, washing system 130 is configured for washing of turbine 100 when turbine 100 is off line (not burning fuel or supplying power). In order to utilize washing system 130, turbine 100 is connected to turning gear and a driving motor (not shown). Furthermore, turbine 100 is permitted to cool down, until the interior volume and surfaces have cooled down sufficiently (e.g., at or below 145° F.) so that the water or cleaning mixture being introduced into turbine 100 will not thermally shock the internal metal and induce creep, or induce any mechanical or structural deformation of the material. In addition, in an exemplary embodiment, control system 190 (shown in FIG. 4) will be suitably programmed so that an operator may not make alterations in the ratio of water to cleaning agent, the cycle times for wash sequences, or the order of steps in wash or rinse cycles. Preferably, such aspects of the washing method will be selected by the turbine manufacturer to accommodate the specifications and configuration of the turbine being washed, as may be readily adapted by one of ordinary skill in the field, have the present disclosure before them.

In exemplary washing system 130 water/cleaning agent supply piping 132 is connected to existing compressor air extraction piping 134, 136 typically at the $9^{th}$ and $13^{th}$ compressor stages) and existing turbine cooling piping 138, 140 (typically at the $2^{nd}$ and $3^{rd}$ turbine stages), already present in known turbine constructions. The foregoing additional piping arrangements are, in exemplary washing system 130, employed in conjunction with, or as an alternative to, bellmouth nozzles (not shown) as described above.

Supply piping 132 includes water supply piping 142 connected to a source 144 of water (preferably deionized water), as well as cleaning agent supply piping 146 connected to a source or sources 148 of cleaning agent, with additional valving (not shown) enabling selection between different sources of cleaning agent, e.g., for cleaning the compressor section 102 versus the turbine section 108. For applications in which turbine 100 employs heavy oil as fuel, such fuel is typically treated with a vanadium-based corrosion/deposit inhibitor, which can form a slag in turbine 100 during operation. Supply piping 132 of system 130 may optionally include magnesium sulfate piping 150 connected to a supply 152 of water-based magnesium sulfate solution. Magnesium sulfate helps prevent the formation of the vanadium-based slag promoted by the use of crude, heavy oil fuels. Each of water supply piping 142, cleaning agent supply piping 146 and magnesium sulfate supply piping 150 includes a pump 153 having a motor 154, as well as valves 156, 158, and return flow circuits 160.

Water supply piping 142, cleaning agent supply piping 146, and optional magnesium sulfate supply piping 150 (if present) lead into mixing chamber 162, with the water forming the primary stream, and the cleaning agent and magnesium sulfate forming secondary streams directed into the primary water stream to ensure thorough mixing. From mixing chamber 162, the combined cleaning mixture (not shown) is directed to cleaning mixture supply manifold 164, controlling the outflow from mixing chamber 162. Manifold 164 includes interlocked valves 166, 168, which, in an exemplary embodiment, are controlled so that only one or the other of valves 166, 168 can be open at any given time (though both of valves 166, 168 can be closed simultaneously). In an alternative exemplary embodiment, valves 166, 168 may be separately and independently controllable.

From manifold 164, cleaning mixture supply branch 170 provides cleaning mixture to bellmouth 112 of turbine 100 (when the appropriate valves are suitably configured). Similarly, cleaning mixture supply line 172 leads to three-way valve 174, which, in turn, leads to cleaning mixture supply branches 176, 178 to supply cleaning mixture, preferably simultaneously, to $9^{th}$ compressor stage air extraction piping 134 and $13^{th}$ compressor stage air extraction piping 136, respectively. Branches 176 and 178 are each provided with quick disconnects 180, which are provided, to be employed when specialty cleaning agents are employed. Cleaning mixture supply piping 182 extends from manifold 164 to three-way valve 184, and on to cleaning mixture branches 186, 188 to supply cleaning mixture, preferably simultaneously, to $2^{nd}$ turbine stage cooling piping 138 and $3^{rd}$ turbine stage cooling piping 140, respectively. Branches 186, 188 are likewise provided with quick disconnects 180, again, for use when specialty cleaning agents are employed.

Figure 4:
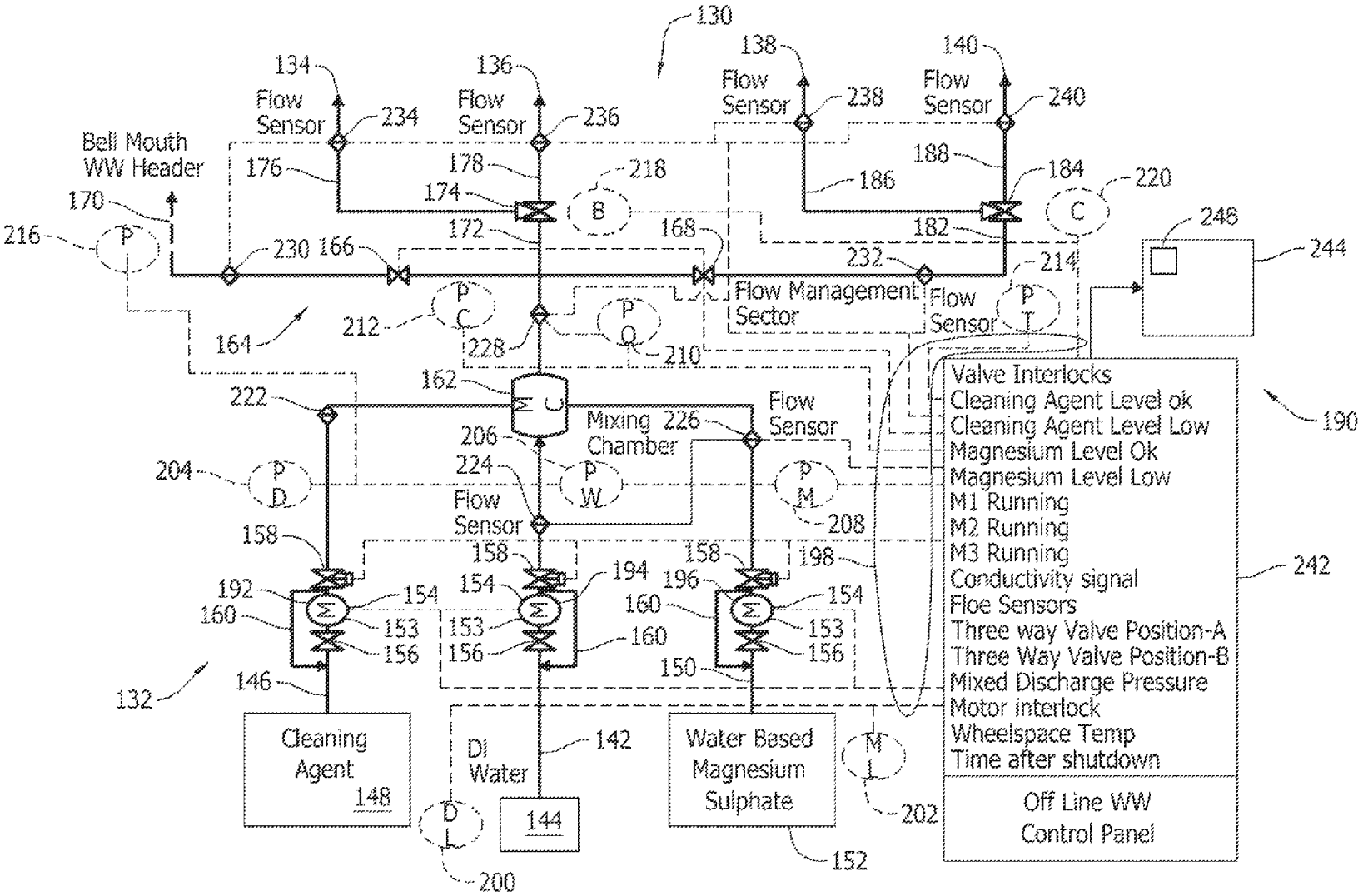
FIG. 4 is a further schematic illustration of an exemplary piping arrangement for supplying water and/or cleaning agents into a turbine engine, including control aspects.

FIG. 4 is a further schematic illustration of an exemplary washing system 130, including control aspects. Washing system 130 incorporates the same piping arrangements as shown in FIG. 3, and accordingly, similar components performing similar functions, as in system 130 of FIG. 3 are given similar reference numerals. Washing system 130 further includes motor sensors 192, 194, and 196 that sense the operation of pumps 153 positioned in cleaning agent supply piping 146, water piping 142 and optional magnesium sulfate piping 150, respectively. Control system 190 further incorporates cleaning agent level sensor 200, magnesium sulfate level sensor 202, cleaning agent pressure sensor 204, water pressure sensor 206, magnesium sulfate pressure sensor 208, cleaning mixture outflow pressure sensor 210, compressor pressure sensor 212 (which senses pressure in compressor section 102 of turbine 100), turbine pressure sensor 214 (which senses pressure in turbine section 108), inlet pressure sensor 216 (which senses pressure in branch 170 at bellmouth 112), which sense various parameters relative to the operation of, and valve position sensors 218 and 220, associated with three-position valves 174, 184, respectively. Control system 190 further includes flow sensors 222, 224, 226, 228, 230, 232, 234, 236, 238, and 240, each of which is configured to sense the rate of flow of the water, cleaning agent, magnesium sulfate, or cleaning mixture flowing (or not flowing) through their respective piping.

In an exemplary embodiment, control system 190 communicates, via communication links 198, with the various pressure, flow and position sensors described herein, and further communicates with actuation mechanisms (not shown) provided to start, stop or control the speed of motors 154, and to open, close, or regulate the position of valves 156, 158, 166, 168, 174 and 184, as required to accomplish the operations of washing system 130, as described herein. Communication links 198 may be implemented in hardware and/or software. In one embodiment, communication links 198 remotely communicate data signals to and from control system 190 in accordance with any wired or wireless communication protocol known to one of ordinary skill in the art guided by the teachings herein. Such data signals may include, but are not limited to one including, signals indicative of operating conditions of the various sensors transmitted to control system 190 and/or various command signals communicated by control system 190 to the sensors shown in FIG. 4, and described herein.

Control system 190 may be a computer system that includes a control panel/display 242, a controller 244, and at least one processor 246. Control system 190 executes programs to control the operation of washing system 130 using sensor inputs and instructions from human operators. User input functionality is provided in control panel/display 242, which acts as a user input selection device, as well as a display of the operating conditions of the various components of washing system 130. For example, control panel/display 242 may provide information on and/or enable instructions to be input by operators on: status and position of valve interlocks controlling valves 166 and 168; cleaning agent level status; magnesium sulfate level status; operation status of pump motors 154 via motor sensors 192; conductivity of the used cleaning mixture exiting turbine 100; flow sensors 222, 224, 226, 228, 230, 232, 234, 236, 238 and 240; three-way valves 174, 184; cleaning mixture outflow pressure sensor 210; motors 154; temperature of the interior/wheel space of turbine 100; and various elapsed times, such as time after shutdown of washing system 130. In the exemplary embodiment, control panel/display 242 may be configured to be responsive to the user pressing contact on control panel/display 242 to selectively perform functionality. Control panel/display 242 may also include a keypad that operates in a conventional well known manner. Thus, the user can operate desired functions available with control system 190 by contacting a surface of control panel/display 242. Commands generated by control system 190 cause the described sensors to monitor operations of washing system 130 and to activate other control settings on washing system 130.

Each of the pressure, position, and flow sensors of control system 190 is suitably configured to provide readouts of their respective sensed values, on control panel 242, which is, in turn, in communication with a suitable controller 244, which incorporates one or more control processors 246.

As used herein, the term processor is not limited to just those integrated circuits referred to in the art as a computer, but broadly refers to a microcontroller, a microcomputer, a programmable logic controller (PLC), an application specific integrated circuit, and other programmable circuits, and these terms are used interchangeably herein. In the embodiments described herein, memory may include, but is not limited to, a computer-readable medium, such as a random access memory (RAM), and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

Figure 5:
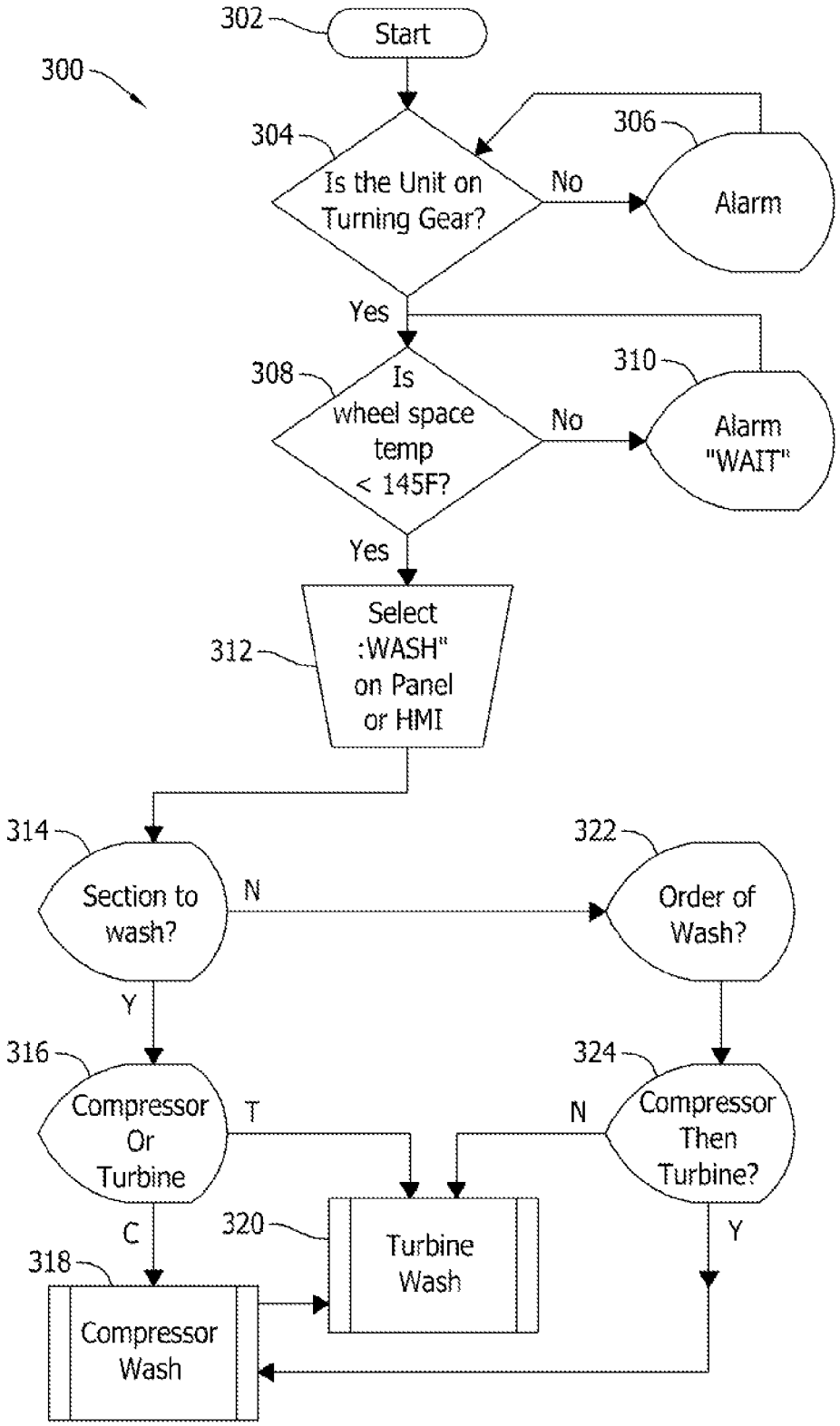
FIG. 5 is a flow chart illustrating a preliminary preparation phase of an exemplary turbine washing process.

FIG. 5 is a flow chart of a preliminary preparation phase 300 of an exemplary method for washing turbine 100. Preparation phase 300 includes initiating 302 the washing process by actuating a start instruction through control panel/display 242. Control system 190 determines 304 whether turbine 100 is rotating at a predefined speed (such as about 3-6 rpm, also referred to as "turning gear" speed) to facilitate the cleaning action of the introduced cleaning mixture. If control system 190 determines that turbine 100 is not rotating at the correct speed, control system 190 actuates 306 an alarm (and/or illuminates a warning light, and/or activates any other suitable warning device). If control system 190 determines that turbine 100 is rotating at the proper speed, control system 190 then determines whether the interior/wheel space of turbine 100 is at the proper temperature (in an exemplary embodiment, preferably less than 145° F.). The interior temperature of turbine 100 must be kept below a temperature that would adversely impact the effectiveness of the cleaning mixture and the integrity and performance of the metallic components. If control system 190 determines that the interior temperature of turbine 100 is in excess of a predefined value, control system 190 actuates 310 an alarm (and/or illuminates a warning light, and/or activates any other suitable warning device). If control system 190 determines that the interior temperature is within predefined limits, control system 190 enables an operator to actuate 312 a "wash" command on control panel/display 242. Control system 190 then displays 314 a prompt or prompts on control panel/display 242 enabling the operator to select whether to individually wash one or the other of compressor section 102 or turbine section 108 to individually wash, or to select a combined wash. If the operator selects the individual wash, control system 190 prompts 316 the operator to choose to wash 318 compressor section 102 or to wash 320 turbine section 108. If the operator selects 316 against the individual wash, control system 190 prompts 322 the operator to select 324 the order of washing of the combined wash.

Figure 6:
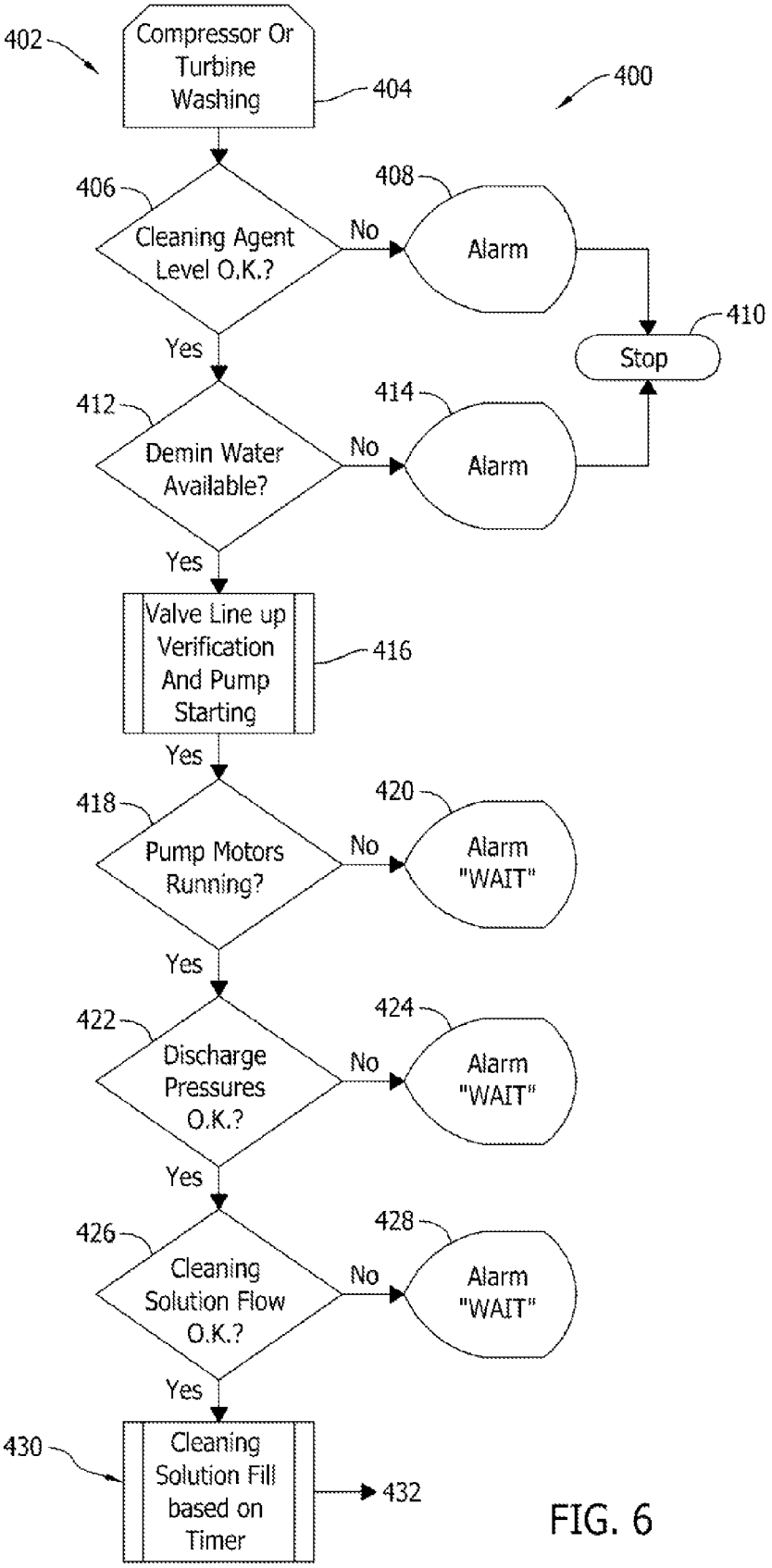
FIG. 6 is a flow chart illustrating a first portion of an exemplary turbine washing process.

FIG. 6 is a flow chart illustrating a first portion 402 of an exemplary turbine washing process 400. Once an operator has selected 404 compressor section 102 or turbine section 108 for washing, control system 190 determines 406 whether the cleaning agent level is at or above a predefined level deemed sufficient for a washing cycle. If insufficient cleaning agent is present, control system 190 actuates 408 an alarm (and/or illuminates a warning light, and/or activates any other suitable warning device). Upon actuation 408 of the alarm, control system 190 stops 410 first portion 402 of turbine washing process 400, either automatically, or upon entry of a command by an operator (such as through touching control panel/display 242), to permit the cleaning agent level to be augmented to be replenished. If control system 190 determines 406 that the cleaning agent level is sufficient for requirements, control system 190 determines 412 whether supply 144 of demineralized water is sufficient for requirements. If control system 190 determines 412 that an insufficient supply 144 of demineralized water is present, control system 190 actuates 414 an alarm (and/or illuminates a warning light, and/or activates any other suitable warning device). Again, control system 190 stops 410 first portion 402 of turbine washing process 400, either automatically or upon entry of a command by an operator, to permit replenishment or restoration of supply 144 of demineralized water.

If control system 190 determines that the supply 144 of demineralized water is sufficient, control system 190 determines 416 the positions of the necessary valves, as described and shown in FIGS. 3 and 4, and causes actuation of such valves as necessary to accomplish the previously selected turbine washing process 400. Control system 190 then verifies 418 whether motors 154 of pumps 153 are running. If control system 190 determines 418 that motors 154 are not running, control system 190 actuates 420 an alarm or signal, such as a signal light indication "WAIT." In an exemplary embodiment, control system 190 may be configured to simply pause the process for a predetermined time, and then re-check the operation of motors 154, and upon detection of motor operation, resume the process. In an alternative exemplary embodiment, control system 190 may cause an instruction to be displayed, indicating that human operator intervention is required, e.g., to confirm motor operation, and, once operation has been confirmed by the operator, the operator may be instructed to press or touch a "RESUME" button (either an actual button, or one on display 242. If control system 190 determines 418 that motors 154 are running, control system 190 then determines 422 whether the discharge pressure of the cleaning mixture leaving mixing chamber 162 is within predefined parameters. If control system 190 determines 422 that the discharge pressure of the cleaning mixture is not within predefined parameters, control system 190 actuates 424 an alarm or signal, such as a signal light indication "WAIT." If control system 190 determines that the discharge pressure of the cleaning mixture is within predefined parameters, control system 190 determines 426 whether the flow rate of the cleaning mixture is sufficient. If control system 190 determines 426 that the flow rate of the cleaning mixture is not within predefined parameters, control system 190 actuates 428 an alarm or signal, such as a signal light indication "WAIT." If control system 190 determines 426 that the flow rate of the cleaning mixture is within predefined parameters, control system 190 supplies 430 cleaning mixture into turbine 100 for a predetermined amount of time.

Figure 7:
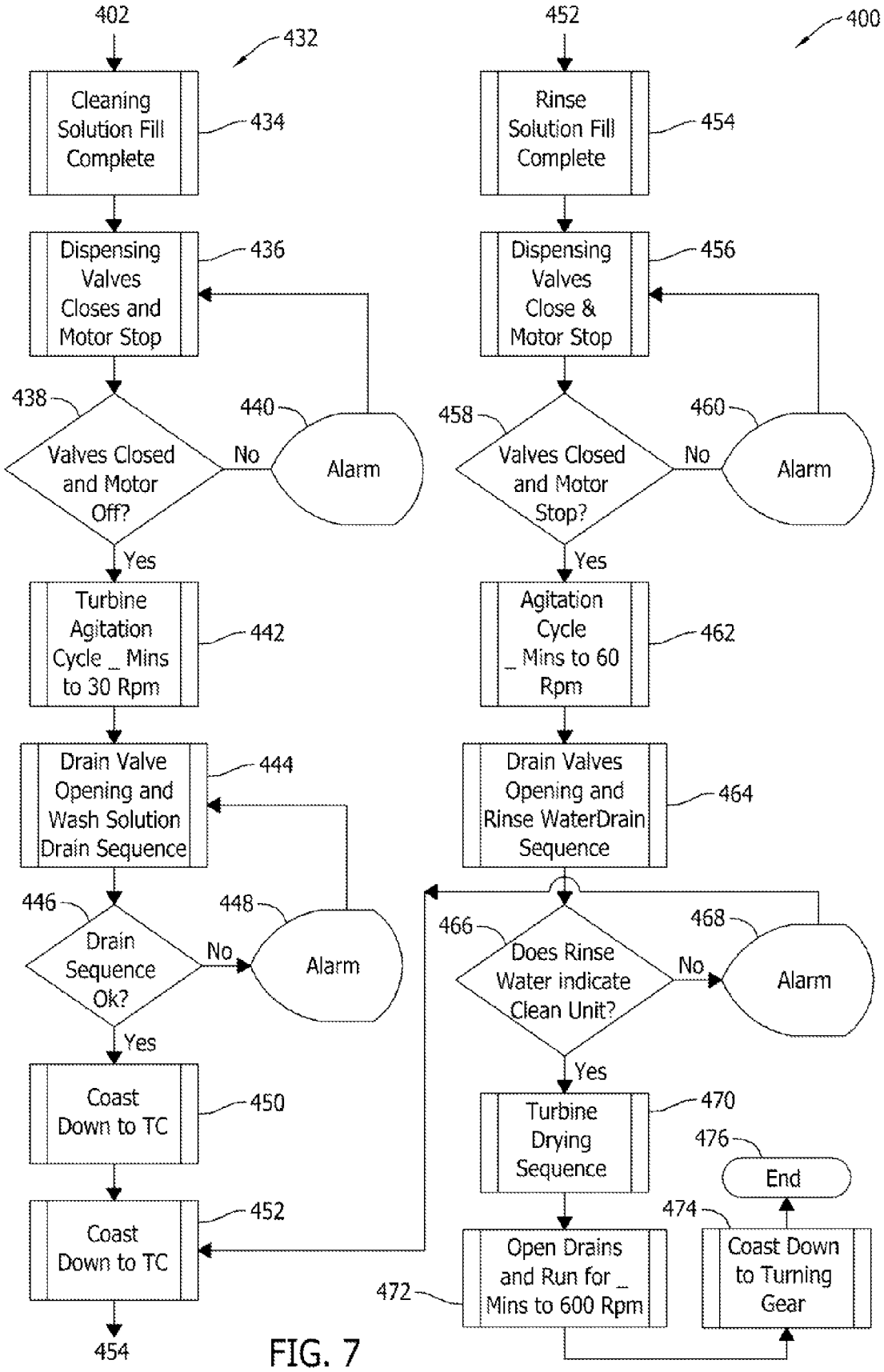
FIG. 7 is a flow chart illustrating a second portion of an exemplary turbine washing process.

FIG. 7 is a flow chart of a second portion 432 of exemplary turbine washing process 400. Upon completion 434 of a timed fill of turbine 100 with cleaning mixture, control system 190 closes 436 the appropriate valves for the particular washing cycle being run and stops the appropriate pump motors 154. Control system 190 verifies 438 whether the requisite valves have been closed and motors stopped. If control system 190 determines that the requisite valves have not been closed and motors stopped, control system 190 actuates 440 an alarm or signal, indicating operator intervention, such as affirmative actuation/de-actuation of the relevant valves or pumps. If control system 190 determines 438 that the requisite valves have been actuated and pump motors stopped, control system 190 continues 442 agitation of the cleaning mixture through motoring of turbine 100 for a predefined period of time (for example, five minutes) and at a predefined rotational/agitation speed, for example, 100 revolutions per minute, to dislodge deposits from the compressor blades and vanes. At the end of the predefined period of time, control system 190 opens 444 drain valves (not shown) and initiates a wash solution drain sequence. Control system 190 determines 446 whether the wash solution drain sequence has been completed. If control system 190 determines that the wash solution drain sequence is not completed, control system 190 actuates 448 an alarm, providing an indication that operator intervention is required. If control system 190 determines that the wash solution drain sequence has been completed, control system 190 removes motive power 450 from turbine 100 to permit turbine 100 to coast down to turning gear speed Once control system 190 senses that the turbine rotation has reached turning gear speed, control system 190 initiates 452 a rinse sequence.

During the rinse sequence, control system 190 introduces deionized water from supply 144 into the interior of turbine 100. In an alternative exemplary embodiment, additional agents to facilitate rinsing may be added to the rinse water. When control system 190 determines 454 that sufficient rinse solution has been introduced into turbine 100, control system 190 closes 456 the requisite valves and stops the relevant pump motors. Control system 190 verifies 458 whether the valves have been closed and the pump motors stopped. If control system 190 determines that the valves have not been closed and the motors stopped, control system 190 actuates 460 an alarm or signal, indicating operator intervention, such as affirmative actuation/de-actuation of the relevant valves or pumps. If control system 190 verifies that the relevant valves have been closed and pump motors stopped, control system 190 initiates 462 an agitation cycle for a predefined period of time (for example, five minutes) and predefined speed of rotation of turbine 100. Upon completion of the timed agitation cycle, control system 190 opens 464 drain valves (not shown) to drain turbine 100.

Control system 190, through sensors (not shown) exposed to the drain water released from turbine 100, detects 466 whether the rinse water is sufficiently clean, indicating that the turbine 100 has been rinsed adequately. In an exemplary washing system, this is accomplished by measuring the conductivity of the discharged rinse water. That is, if the conductivity of the rinse water is above or below a predefined value, depending upon the cleaning agent(s) employed then further rinsing is needed. If control system 190 determines that the rinse water is not "clean" enough, control system 190 actuates 468 an alarm, indicating that the rinse sequence should be re-started. In addition, evacuated rinse water is filtered; if debris or deposit material in excess of a predefined amount is detected, the entire wash cycle may have to be repeated.

If control system 190 determines, from the condition of the turbine rinse water that turbine 100 has been adequately rinsed, control system 190 initiates 470 a turbine drying sequence, in which control system 190 opens 472 drains and causes turbine 100 to be rotated for a predefined time and at a predefined rotational speed, for example 800-1200 revolutions per minute. During drying, all drain valves are maintained in open position to facilitate draining of the rinse water into the draining system (not shown) of the facility where turbine 100 is located. After the predefined drying time has elapsed, control system 190 causes turbine 100 to coast 474 by removing motive power from turbine 100. Once control system 190 has sensed that turbine 100 has coasted back to turning gear speed, washing process 400 is terminated 476.

The invention described herein provides several advantages over known methods of turbine cleaning, such as: the ability to introduce water and/or cleaning agents deep into turbine structures at several locations simultaneously, particularly including the aft stages of turbine engines; the ease of implementation, as existing turbine air extraction piping is employed; the use of "fixed" control programming will preclude ad hoc variations in protocol that can reduce cleaning efficiency and/or damage equipment; the ability to sidestep the problem of nozzle plugging that arises in bellmouth-only cleaning mixture introduction methods; the ability to use different types of cleaning agent into different areas of the turbine; and the provision of more effective washing leading to fewer washing cycles, less downtime for the turbine due to washing generally and manual washing of aft stages in particular, and less erosion of the turbine components due to washing.

Exemplary embodiments of a method, a system and an apparatus for cleaning turbine engine components are described above in detail. The method and system are not limited to the specific embodiments described herein, but rather, components of systems and/or steps of the methods may be utilized independently and separately from other components and/or steps described herein. For example, the present method, system and apparatus facilitate not only the cleaning of the compressor and turbine stages of fixed-mounted turbine engines for power generation, but may be readily adapted for other turbine applications, such as Aero derivative engines.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

While the invention has been described in terms of various specific embodiments, those skilled in the art will recognize that the invention can be practiced with modification within the spirit and scope of the claims.

What is claimed is:

1. A turbine engine system comprising:

a turbine engine including a compressor section, a turbine section, compressor section air extraction piping, and turbine section air extraction piping;

water supply piping, connected in flow communication with a supply of water;

cleaning agent supply piping connected in flow communication with at least one supply of cleaning agent;

a mixing chamber, connected in flow communication with the water supply piping and the cleaning agent supply piping, the mixing chamber being configured to receive water from the water supply piping and at least one cleaning agent from the cleaning supply piping, and produce a cleaning mixture;

cleaning mixture supply piping, connected in flow communication with the mixing chamber, the cleaning mixture supply piping being connected in flow communication with the compressor section air extraction piping and the turbine section air extraction piping to selectively supply cleaning mixture to one of the compressor section and the turbine section;

at least one pump, connected in flow communication with at least one of the water supply piping, the cleaning agent supply piping, and the cleaning mixture piping; and a control system, connected to the water supply piping, the cleaning agent supply piping, the cleaning mixture piping, and the at least one pump, the control system operably configured to regulate flow of water, cleaning agent, and cleaning mixture through the water supply piping, the cleaning agent supply piping, and the cleaning mixture supply piping, respectively.

2. A turbine engine system according to claim 1 comprising:

slag inhibitor piping, connected in flow communication with a supply of slag inhibitor, and in flow communication with the mixing chamber.

3. A turbine engine system according to claim 1 wherein the cleaning mixture supply piping further comprises:

a cleaning mixture supply manifold, connected in flow communication with the mixing chamber;

compressor section supply branch piping, connected in flow communication with the cleaning mixture supply manifold to supply cleaning mixture from the cleaning mixture supply manifold to the compressor section of the turbine engine; and turbine section supply branch piping connected in flow communication with the cleaning mixture supply manifold to supply cleaning mixture from the cleaning mixture supply manifold to the turbine section of the turbine engine.

4. A turbine engine system according to claim 3 wherein the cleaning mixture supply piping further comprises:

turbine bellmouth supply branch piping connected in flow communication with the cleaning mixture supply manifold to supply cleaning mixture from the cleaning mixture supply manifold to the bellmouth of the turbine engine.

5. A turbine engine system according to claim 1 wherein the control system further comprises:

a control processor;

a control display associated with the control processor; and at least one pressure sensor, positioned in at least one of the water supply piping, the cleaning agent supply piping, and the cleaning mixture supply piping, the at least one pressure sensor in data communication with the control processor, for sensing pressure of fluid in said at least one of the water supply piping, the cleaning agent supply piping, and the cleaning mixture supply piping.

6. A turbine engine system according to claim 5 wherein the control system further comprises:

at least one flow control valve, positioned in at least one of the water supply piping, the cleaning agent supply piping, and the cleaning mixture supply piping, the at least one flow control valve in communication with the control processor, for enabling actuation of the at least one flow control valve between at least open and closed positions, said actuation caused by the control processor.

7. A turbine engine system according to claim 5 wherein said control system further comprises:

at least one flow sensor, disposed in at least one of the water supply piping, the cleaning agent supply piping, and the cleaning mixture supply piping, the at least one flow sensor in communication with the control processor, for sensing flow of fluid in said at least one of the water supply piping, the cleaning agent supply piping, and the cleaning mixture supply piping.

8. A method for cleaning a turbine engine having a compressor section, a turbine section, compressor air extraction piping and turbine air extraction piping, said method comprising:

connecting water supply piping in flow communication with a supply of water;

connecting cleaning agent supply piping in flow communication with at least one supply of cleaning agent;

connecting a mixing chamber in flow communication with the water supply piping and the cleaning agent supply piping, the mixing chamber configured to receive water from the water supply piping and at least one cleaning agent from the cleaning supply piping, and produce a cleaning mixture;

connecting cleaning mixture supply piping in flow communication with the mixing chamber;

connecting the cleaning mixture supply piping connected in flow communication with the compressor section air extraction piping and the turbine section air extraction piping to selectively supply cleaning mixture to one of the compressor section and the turbine section; and connecting a control system to the water supply piping, the cleaning agent supply piping, and the cleaning mixture piping to regulate flow of water, cleaning agent, and cleaning mixture through the water supply piping, the cleaning agent supply piping, and the cleaning mixture supply piping, respectively.

9. A method for cleaning a turbine engine according to claim 8 comprising:

connecting slag inhibitor piping in flow communication with a supply of slag inhibitor, and in flow communication with the mixing chamber.

10. A method for cleaning a turbine engine according to claim 8 wherein connecting the cleaning mixture supply piping connected in flow communication with the compressor section air extraction piping and the turbine section air extraction piping to selectively supply cleaning mixture to one of the compressor section and the turbine section further comprises:

connecting a cleaning mixture supply manifold in flow communication with the mixing chamber;

connecting compressor section supply branch piping in flow communication with the cleaning mixture supply manifold to supply cleaning mixture from the cleaning mixture supply manifold to the compressor section of the turbine engine; and connecting turbine section supply branch piping, in flow communication with the cleaning mixture supply manifold to supply cleaning mixture from the cleaning mixture supply manifold to the turbine section of the turbine engine.

11. A method for cleaning a turbine engine according to claim 10 wherein connecting the cleaning mixture supply piping connected in flow communication with the compressor section air extraction piping and the turbine section air extraction piping to selectively supply cleaning mixture to one of the compressor section and the turbine section further comprises:

connecting turbine bellmouth supply branch piping in flow communication with the cleaning mixture supply manifold to supply cleaning mixture from the cleaning mixture supply manifold to the bellmouth of the turbine engine.

12. A method for cleaning a turbine engine according to claim 8 wherein connecting a control system to the water supply piping, the cleaning agent supply piping, and the cleaning mixture piping to regulate flow of water, cleaning agent, and cleaning mixture through the water supply piping, the cleaning agent supply piping, and the cleaning mixture supply piping, respectively, comprises:

providing a control processor;

providing a control display associated with the control processor; and positioning at least one pressure sensor in at least one of the water supply piping, the cleaning agent supply piping, and the cleaning mixture supply piping, the at least one pressure sensor in data communication with the control processor, for sensing pressure of fluid in said at least one of the water supply piping, the cleaning agent supply piping, and the cleaning mixture supply piping.

13. A method for cleaning a turbine engine according to claim 12 wherein connecting a control system to the water supply piping, the cleaning agent supply piping, and the cleaning mixture piping to regulate flow of water, cleaning agent, and cleaning mixture through the water supply piping, the cleaning agent supply piping, and the cleaning mixture supply piping, respectively, comprises:

positioning at least one flow control valve in at least one of the water supply piping, the cleaning agent supply piping, and the cleaning mixture supply piping, the at least one flow control valve in communication with the control processor, for enabling actuation of the at least one flow control valve between at least open and closed positions, said actuation caused by the control processor.

14. A method for cleaning a turbine engine according to claim 12 wherein connecting a control system to the water supply piping, the cleaning agent supply piping, and the cleaning mixture piping to regulate flow of water, cleaning agent, and cleaning mixture through the water supply piping, the cleaning agent supply piping, and the cleaning mixture supply piping, respectively, comprises:

positioning at least one flow sensor in at least one of the water supply piping, the cleaning agent supply piping, and the cleaning mixture supply piping, the at least one flow sensor in communication with the control processor, for sensing flow of fluid in said at least one of the water supply piping, the cleaning agent supply piping, and the cleaning mixture supply piping.

15. A method for cleaning a turbine engine according to claim 12 further comprising:

supplying water to the mixing chamber;

supplying cleaning agent to the mixing chamber;

transporting cleaning mixture from the mixing chamber to the cleaning mixture supply manifold;

transporting cleaning mixture from the cleaning mixture supply manifold to one of the compressor section of the turbine engine and the turbine section of the turbine engine; and agitating the cleaning mixture by rotating the turbine engine at a predefined rotational speed.

16. A method for cleaning a turbine engine according to claim 15 comprising:

draining used cleaning mixture from the turbine engine.

17. A method for cleaning a turbine engine according to claim 16 comprising:

supplying rinse water through the mixing chamber, the cleaning mixture manifold, and the cleaning mixture piping, and into one of the compressor section of the turbine engine and the turbine section of the turbine; and agitating the rinse water by rotating the turbine engine at a predefined rotational speed.

18. A method for cleaning a turbine engine according to claim 17 comprising:

draining used rinse water from the turbine engine; and drying the turbine engine by rotating the turbine engine at a predefined rotational speed.

19. A method for cleaning a turbine engine according to claim 18 further comprising:

testing the used rinse water to determine whether a predefined level of cleaning has been attained;

re-rinsing the turbine engine if the predefined level of cleaning has not been achieved.

20. A system for cleaning a turbine engine having a compressor section, a turbine section, compressor air extraction piping and turbine air extraction piping, said system comprising:

water supply piping, connected in flow communication with a supply of water;

cleaning agent supply piping connected in flow communication with at least one supply of cleaning agent;

a mixing chamber, connected in flow communication with the water supply piping and the cleaning agent supply piping, the mixing chamber being configured to receive water from the water supply piping and at least one cleaning agent from the cleaning supply piping, and produce a cleaning mixture;

cleaning mixture supply piping, connected in flow communication with the mixing chamber, the cleaning mixture supply piping being connected in flow communication with the compressor section air extraction piping and the turbine section air extraction piping to selectively supply cleaning mixture to one of the compressor section and the turbine section;

at least one pump, connected in flow communication with at least one of the water supply piping, the cleaning agent supply piping, and the cleaning mixture piping; and a control system, connected to the water supply piping, the cleaning agent supply piping, the cleaning mixture piping, and the at least one pump, the control system operably configured to regulate flow of water, cleaning agent, and cleaning mixture through the water supply piping, the cleaning agent supply piping, and the cleaning mixture supply piping, respectively.

* * * * *